United States Patent [19]

Noguchi et al.

[11] 4,050,038

[45] Sept. 20, 1977

[54] EDGE-GUIDED MODE NON-RECIPROCAL CIRCUIT ELEMENT FOR MICROWAVE ENERGY

[75] Inventors: Tsutomu Noguchi; Yoshihiko Akaiwa; Hidehiko Katoh, all of Tokyo, Japan

[73] Assignee: Nippon Electric Company, Ltd., Tokyo, Japan

[21] Appl. No.: 609,489

[22] Filed: Sept. 2, 1975

[30] Foreign Application Priority Data

| | | |
|---|---|---|
| Sept. 4, 1974 | Japan | 49-101665 |
| Sept. 4, 1974 | Japan | 49-101666 |
| Feb. 3, 1975 | Japan | 50-15681 |
| Sept. 4, 1974 | Japan | 49-101667 |
| Jan. 31, 1975 | Japan | 50-14816 |

[51] Int. Cl.[2] ..... H01P 1/36; H01P 1/38

[52] U.S. Cl. ..... 333/1.1; 333/24.2

[58] Field of Search ..... 333/1.1, 24.2

[56] References Cited

U.S. PATENT DOCUMENTS

| | | | |
|---|---|---|---|
| 3,534,299 | 10/1970 | Eberhardt | 333/24.2 |
| 3,617,951 | 11/1971 | Anderson | 333/1.1 |
| 3,886,502 | 5/1975 | Radding et al. | 333/24.2 |
| 4,006,434 | 2/1977 | De Santis et al. | 333/1.1 |

*Primary Examiner*—Paul L. Gensler

*Attorney, Agent, or Firm*—Ostrolenk, Faber, Gerb & Soffen

[57] ABSTRACT

Isolators and asymmetrical circulators of the non-reciprocal type employing tapered conductors positioned upon a ferrimagnetic member wherein means are provided for creating a localized non-uniform D.C. magnetic field in the region of one edge of the tapered conductor and of a field strength sufficient to cause the ferrimagnetic slab to create a magnetic resonance condition within a predetermined frequency range.

In one embodiment the non-uniform localized magnetic field is produced by a magnetic member positioned along said one edge.

In another embodiment the magnetic member may be eliminated and the said one edge may be aligned with or extended beyond one edge of the ferrimagnetic slab to obtain the non-uniform magnetic field.

11 Claims, 25 Drawing Figures

FIG. 10a.
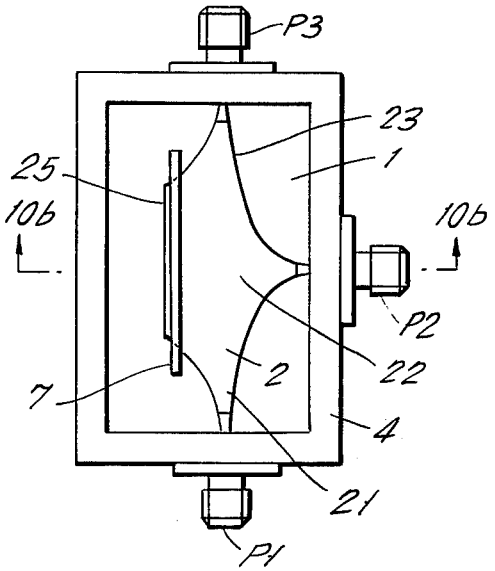
FIG. 15a.
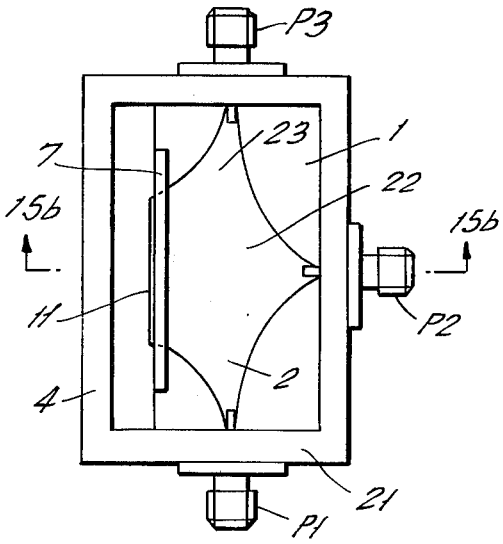
FIG. 10b.
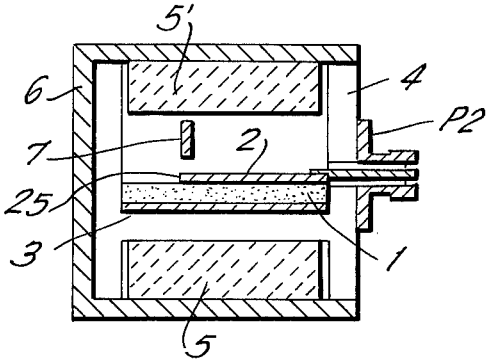
FIG. 15b.
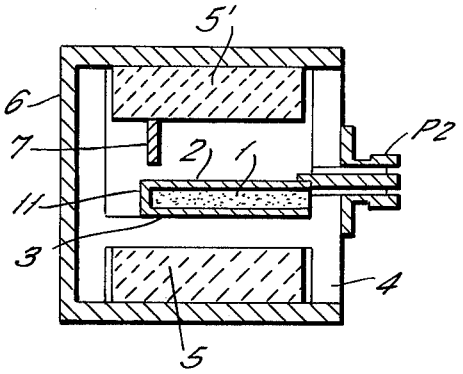
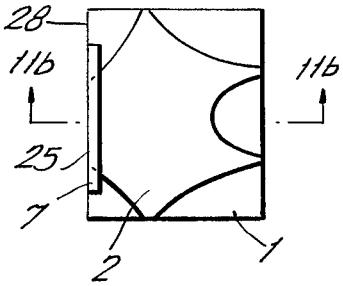
FIG. 11a.
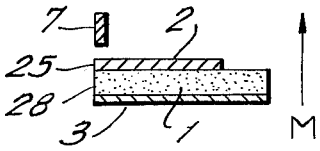
FIG. 11b.

EDGE-GUIDED MODE NON-RECIPROCAL CIRCUIT ELEMENT FOR MICROWAVE ENERGY

The present invention relates to microwave non-reciprocal circuits, and more particularly to wide-band isolators and asymmetrical circulators of the type using an edge-guided mode.

BACKGROUND OF THE INVENTION

Introduced by M. E. Hines in the IEEE Transaction on Microwave Theory and Techniques, Vol. MTT-19, No. 5, May 1971, the edge-guided mode has been utilized in ferrimagnetic stripline circuits, in which wave energy is concentrated along one edge thereof. M. E. Hines made use of this phenomenon in realizing an isolator of wider band characteristics by installing a resistance element at one end of the line conductor. This isolator, however, is intricate in construction because of the resistance element used. Furthermore, in this type of isolator, the greater the isolation desired, the larger the required size of the resistance element, with the result that the overall size of the isolator becomes inevitably enlarged.

Another prior art isolator, proposed by K. Araki et al in The Institute of Electronics and Communication Engineers of Japan, Microwave Conference, Paper No. MW74-20, June 1974, has desirable characteristics, which have been achieved by grounding one end of the line conductor, instead of using Hines' resistance element. This isolator, however, must be fabricated three-dimensionally because the line conductor is of three-dimensional construction. Furthermore, the isolator can operate only within a comparatively narrow frequency band.

BRIEF DESCRIPTION OF THE INVENTION AND OBJECTS

It is therefore an object of the invention to provide a non-reciprocal circuit element of the strip-line type and which is simple in construction, small in size, and operable over a wide frequency band and therefore free of prior art drawbacks.

With this and other objects in view, the invention provides a non-reciprocal circuit element for microwave energy comprising: a strip-line conductor having an increasing taper toward the center thereof in the longitudinal direction from the input and output terminal port; a grounding conductor of a given shape; a ferrimagnetic slab interposed between the strip-line conductor and the grounding conductor; a means for applying an approximately uniform DC magnetic field to the ferrimagnetic slab in a direction perpendicular to the plane of the slab; and a means for applying a DC magnetic field locally and which is superimposed upon an area near one edge of the wide portion of the line conductor, the latter DC magnetic field having a distribution of field intensity strong enough to cause the ferrimagnetic slab to bring about a magnetic resonance in a predetermined frequency range.

BRIEF DESCRIPTION OF THE FIGURES

Other objects, features and advantages of the invention will become more apparent from the following detailed description taken in conjunction with the accompanying drawings, wherein:

FIG. 10*a* is a plan view of a circulator realized as a third embodiment of the invention, and the FIG. 10*b* is a cross-sectional view taken across 10*b*—10*b* of FIG. 10*a*, FIG. 11*a* is a plan view of a circulator of a fourth embodiment of the invention, and FIG. 11*b* is a cross-sectional view taken across 11*b*—11*b* of FIG. 11*a*.

FIG. 15*a* is a plan view showing a circulator of a seventh embodiment of the invention, and FIG. 15*b* is a cross-sectional view taken across 15*b*—15*b* of FIG. 15*a*.

DETAILED DESCRIPTION OF THE INVENTION

Figure 1:
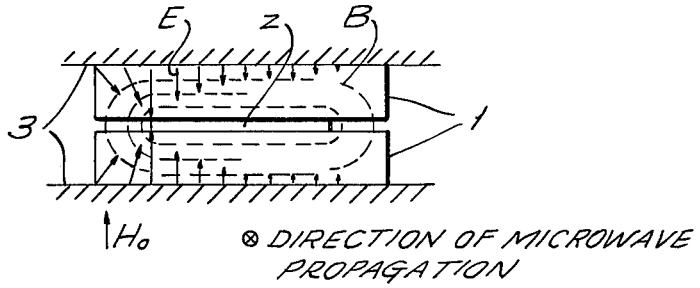
FIG. 1 (PRIOR ART)
FIG. 1 is a schematic diagram showing an electromagnetic distribution in the edge-guided mode.

The edge-guided mode disclosed by M. E. Hines will be described by referring to FIG. 1, in which an isolator construction is schematically shown comprising ferrimagnetic slabs 1, a line conductor 2, and grounding conductors 3. The line conductor 2 is installed between the slabs, which are sandwiched between the grounding conductors. When a DC magnetic field $H_o$ is applied in the direction perpendicular to the plane of the ferrimagnetic slab, RF electromagnetic fields E and B are developed along one edge of the line conductor in a direction perpendicular to the wave propagation direction. This signifies the fact that there are electromagnetic waves propagated into the plane of the Figure. Then, with the wave propagation direction reversed, the electromagnetic fields are concentrated along the opposite edge thereof. Thus, when an apparatus utilizes a resistance element or the like to bring about field loss along one edge, the edge-guided mode along one edge incurs a large loss, but the edge-guided mode along the other edge experiences no loss. This is the principle of the isolator proposed by M. E. Hines.

Figure 2:
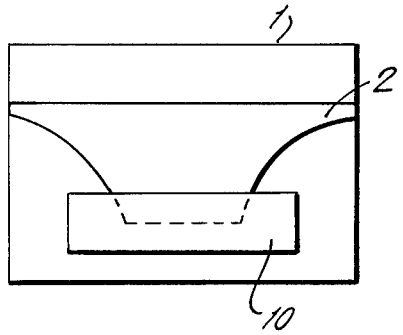
FIG. 2 (PRIOR ART)
FIGS. 2 and 3 are schematic plan view of the prior art strip-line isolators.

FIG. 2 schematically shows the construction of this prior art isolator, in which a line conductor 2 is formed on a ferrimagnetic slab 1, a wave absorber 10 is installed along one edge of the line conductor 2, and the edge-guided mode for propagation in the direction in which electromagnetic waves are concentrated along the edge with the wave absorber incurs a large energy loss.

Figure 3:
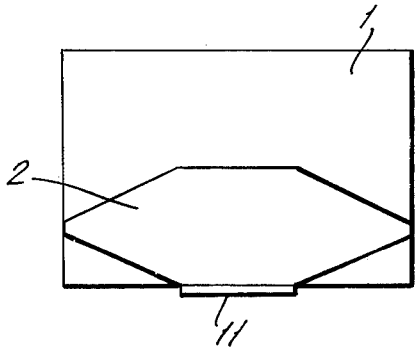
FIG. 3 (PRIOR ART)

Referring to FIG. 3, there is schematically shown an isolator proposed by K. Araki et al. This isolator is such that a shorting bar 11 is installed at one edge of the center of a line conductor 2 to provide a short circuit between part of the line conductor 2 and the grounding conductors 3.

In the isolator shown in FIG. 2, because the wave absorber 10 is used to bring about loss along one edge, the length of the wave absorber must be extended if an isolation of some 20 dB is desired. This will lead to an added increase in the size of the device. In the isolator shown in FIG. 3, the use of the shorting bar 11 requires the line conductor to be constructed three-dimensionally, causing production processes to be complicated. Furthermore, this isolator can only operate in a comparatively narrow frequency band.

Figure 4:
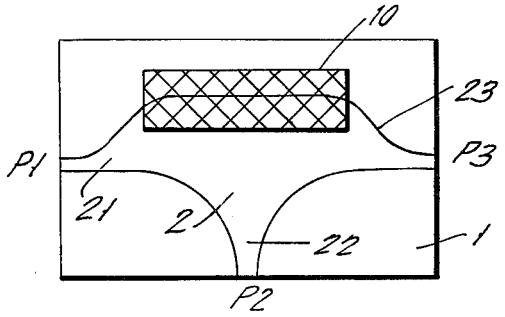
FIG. 4 (PRIOR ART)
FIG. 4 is a schematic plan view of a prior art strip-line circulator.
Figure 5:
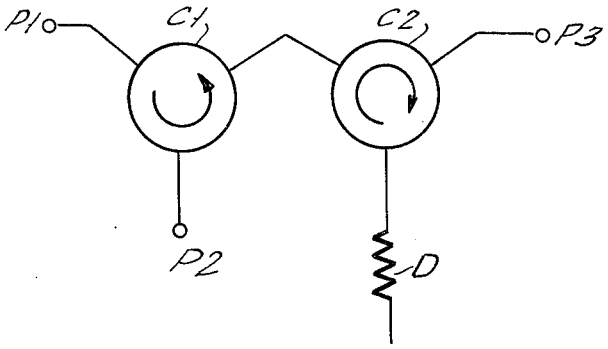
FIG. 5 is a diagram showing an equivalent circuit of the circulator shown in FIG. 4.

A circulator proposed by M. E. Hines is schematically shown in FIG. 4. This edge-guided mode circulator comprises a ferrimagnetic slab 1 magnetized in a direction perpendicular to the plane thereof, a line conductor 2 of tapered shape which has port sections 21, 22, and 23 and is formed on the slab 1, and a resistance element 10 installed along one edge of the line conductor 2. Assuming that the forward propagation occurs counterclockwise and there are ports P1, P2 and P3, then the relationship between the input and output waves passing through the ports may be approximately equivalently expressed by the circuit shown in FIG. 5. This circuit comprises two three-terminal circulators C1 and C2, and ports P1, P2 and P3 corresponding to those shown in FIG. 4. A reflectionless termination D is connected as a load to one terminal of the circulator C2. In this construction, the isolator function is established between the ports P1 and P2 and between P2 and P3 when the directions P1→P2 and P2→P3 are forward. Here the ports P1 and P3 are always isolated from each other.

In microwave circuits, the non-reciprocal circuit as described above is often used although it is not very fundamental as a single circulator. In practice, for example, an amplifier stable against load variations can be formed when a reflection-type amplifier is connected to the port P2, and the port P3 is used as the output terminal. Hence the edge-guided mode circuit as in FIG. 4, although asymmetrical in construction, can serve as a practical non-reciprocal circuit simplified from an intricate circuit shown in FIG. 5. Generally, the edge-guided mode circulator has a much wider frequency band than junction circulators. Furthermore, the former type needs no sophisticated matching circuits as opposed to the latter and hence is highly beneficial from the point of view of yield and production cost.

In the edge-guided mode circulator, the value of isolation of P3 from P1 is the most important parameter. In the amplifier as described above, for example, if the isolation is small relative to its gain, instability of oscillation will occur. In the prior art circulator shown in FIG. 4, an isolation is obtained by merely loading a sheet of resistance element; its value normally ranges from 10 to 20 dB at best. In prior art techniques, therefore, a substantial isolation can only be realized at the sacrifice of an added increase in the size of the device ascribed to the need for a resistance element of greater size. Furthermore, loading the resistance element involves many manufacturing difficulties.

Figure 6:
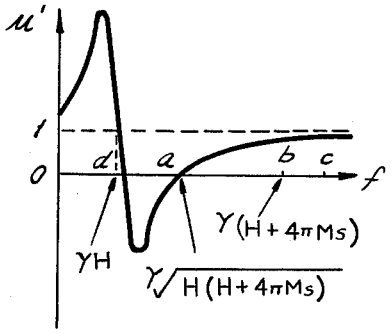
FIG. 6 is a graphic diagram showing the frequency characteristic of the diagonal component of permeability tensor in a polycrystal ferrimagnetic material.
Figure 7A:
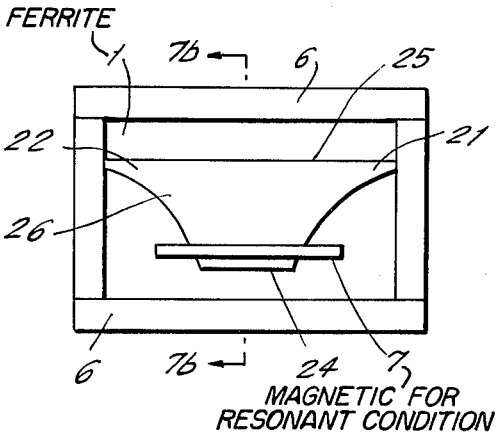
FIG. 7*a* is a plan view showing an isolator of a first embodiment of the invention.

FIG. 6 shows the frequency characteristic of the real part $\mu'$ of the diagonal component $\mu$ of the permeability tensor of a ferrimagnetic slab with its internal DC field H fixed, the slab being large in size relative to its thickness. In FIG. 6, the reference $\gamma$ denotes the gyromagnetic ratio, and $4\pi Ms$, the saturation magnetization of the ferrimagnetic slab. It is known that the frequency region where wave energy can be propagated with low loss in a single edge-guided mode is a region where $\mu'$ is positive and the frequency $f$ is below the cutoff frequency of higher order modes. This frequency region, as shown in FIG. 6, ranges from a point a at which $\mu'$ is zero to point c at which the frequency $f$ is slightly higher than at point $b$ where the effective permeability turns to zero. A magnetic resonance frequency appears at point d, and the electromagnetic field of its frequency component is absorbed by the ferrimagnetic slab whereby a great energy loss takes place.

According to the invention, a DC magnetic field strong enough to cause a ferrimagnetic body to bring about a magnetic resonance in a high frequency region where edge-guided mode energy can propagate is distributed along one edge of the line conductor. The invention utilizes this magnetic resonance as a wave energy loss mechanism. Thus it becomes possible to control the frequency of the loss mechanism by controlling the intensity of the DC magnetic field applied locally, and the frequency band can be widened by increasing the intensity of the local DC magnetic field applied.

With reference to FIG. *7a*, a plan view is shown to illustrate the construction of an isolator of a first embodiment of the invention. (For simplicity, the magnet to be installed on the upper side is not shown.) FIG. *7b* is a cross-sectional view taken across *7b*—*7b* of FIG. *7a*. The isolator comprises a grounding conductor 3 of a given shape, a ferrimagnetic slab 1, and a wide-edged line conductor 26 having at both ends tapered port sections 21 and 22 for establishing impedance matching with external circuits. This line conductor is formed on the ferrimagnetic slab 1. The magnetic circuit comprises magnets 5, 5' for applying an approximately uniform DC magnetic field to the ferrimagnetic slab 1 in the direction perpendicular to the plane of the slab 1, a magnetic plate 7, usually of soft iron, for locally distributing a DC magnetic field strong enough to cause the slab 1 to bring about a magnetic resonance in a predetermined frequency range, and a magnetic circuit enclosure 6. The material of the magnetic plate 7 may be a magnetic metal such as magnetic shunt alloy, or a magnet of barium ferrite, alnico, or the like.

Figure 8:
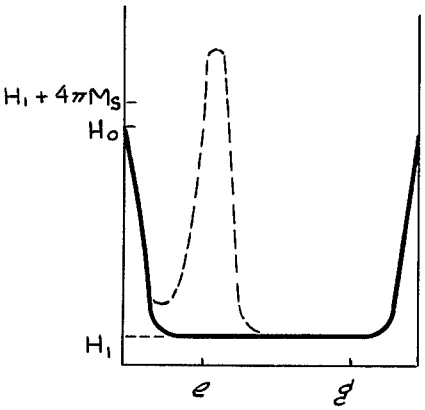
FIG. 8 is a graphic diagram showing the magnetic DC field intensity distribution in the plane of the cross-section 7*b*—7*b* of the isolator shown in FIG. 7*a*.

FIG. 8 shows the distribution of the internal DC magnetic field in the ferrimagnetic slab 1 across phantom line *7b*—*7b* of FIG. *7a*, the solid line indicates the distribution without the magnetic plate 7, and the broken line shows the distribution including the magnetic circuit of magnetic plate 7. The point *e* indicates the place where the edge 24 of the wide-edge portion of the line conductor is located, and the point *g* the place where the other edge 25 thereof is located.

An approximately uniform internal magnetic field exists in the center part of the slab under the state that no magnetic circuit is installed and a uniform field is applied. In the frequency region from $f_a$ to $f_c$ between points *a* and *c* corresponding to internal DC field $H_1$, the edge-guided mode is a single mode where waves ar propagated with low loss.

However, when a magnetic circuit is formed by the magnetic plate 7 near the other edge 24 to provide an internal field distribution strong enough to cause the slab 1 to bring about a magnetic resonance in the frequency region of $f_a$ to $f_c$, then the wave energy propagated in the direction in which electromagnetic waves are concentrated along the edge 24 where the magnetic circuit is provided incurs a great loss due to magnetic resonance absorption. This is an edge-guided mode isolator.

Tabulated below are some concrete data on an isolator of the invention using a ferrimagnetic slab of YIG. This isolator is such that the isolation is greater than 20 dB, the insertion loss is less than 0.8 dB, and the bandwidth is as wide as 3.1 GHz (4.0 to 7.1 GHz). In the frequency band from 4.3 to 6.9 GHz, the isolation is as large as 25 dB or more, and the insertion loss is as low as 0.3 to 0.5 dB.

| | |
|---|---|
| DC Field ($H_o$) | 1800 oersted |
| Ferrimagnetic Slab: | |
| Saturation Magnetization ($4\pi Ms$) | 1800 Gauss |
| Size | 0.5(t)×20(w)×500(1)mm |
| Soft Iron Plate: | |
| Field by Soft Iron Plate | approx. 3900 oersted |
| Size | 0.6(t)×6.1(w)×20(1)mm |
| Strip-Line Conductor: | |
| Size of Wide Portion | 10(w)×20(1)mm |
| Location | Center of Slab YIG |

Figure 7B:
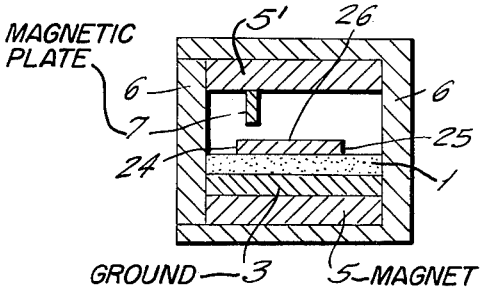
FIG. 7*b* is a cross-sectional view taken across 7*b*—7*b* of FIG. 7*a*.
Figure 9:
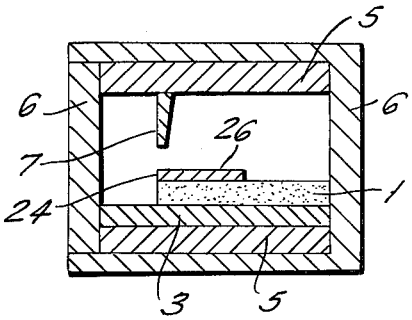
FIG. 9 is a cross-sectional view, similar to FIG. 7, of another isolator realized as a second embodiment of the invention.

FIG. 9 is a cross-sectional view showing a second embodiment of the invention, in which a line conductor 26 is located at the end of slab 1 unlike the one shown in FIG. 7*b*, and the wide edge 24 of the line conductor meets the edge of the slab 1, and the end of the soft iron plate 7 faces the edge of the slab 1. As indicated by the solid line curve in FIG. 8, the field intensity varies in the ferrimagnetic slab 1 even if a uniform field $H_o$ is applied. Along the edge of the slab 1, the internal field is equal to the external field $H_o$. In a ferrimagnetic slab large in size relative to its thickness, the internal field intensity is larger by about $4\pi Ms$ along the wide edge 24 of the line conductor, the field to be superposed thereupon by the magnetic circuit 7 can be minimized and hence the length of the magnetic circuit can be reduced, the size of the magnet 5 can also be reduced, and thus an isolator device of sufficiently small size can be realized.

Referring to FIG. 10*a*, there is shown a plan view to illustrate a third embodiment of the invention, with its magnetic circit removed. FIG. 10*b* is a cross-sectional view taken across 10*b*—10*b* of FIG. 10*a* with its magnetic circuit installed. A tapered line conductor 2 having port sections 21, 22 and 23 is formed on one side of the ferrimagnetic slab 1, and a grounding conductor 3 is formed on the other side thereof. This assembly is housed in a body 4. A bias field is applied perpendicular to the slab from magnets 5 and 5' and magnetic circuit case 6, and connectors are fitted to ports P1, P2, and P3 whereby an edge-guided mode circulator circuit is formed. In this embodiment, a thin magnetic plate 7 is disposed along one edge 25 of the line conductor 2, on which portion a strong field is locally superposed. The ferrimagnetic slab 1 is strongly magnetized along the edge 25 by the magnetic plate 7 to cause the slab to bring about magnetic resonance absorption whereby the edge-guided mode energy propagated along the edge 25 is largely attenuated and a very large isolation is obtained between ports P1 and P3. The frequency characteristic of this isolation can be arbitrarily controlled by suitably determining the shape and mounting position of the magnetic plate 7, the property of the material of the magnetic plate 7, and by changing the distribution of the local field. Accordingly, the bandwidth can be expanded over the entire frequency range for propagation of edge-guided mode energy.

Referring to FIG. 11*a*, there is shown a plan view of the essential part of a fourth embodiment of the invention. The cross-section through 11*b*—11*b* is shown in FIG. 11*b*. A grounding conductor 3 and a line conductor 2 are formed respectively on opposite sides of ferrimagnetic slab 1 which is magnetized under a uniform field M whereby a four-port edge-guided mode circulator is constituted. The edge portion 25 is located at the end of the ferrimagnetic slab 1 unlike the one disposed in the center thereof as in the third embodiment. The magnetic plate 7 is located above the edge 28 of the slab 1. In this construction, a certain amount of local internal field is spontaneously produced in the vicinity of the edge 28 of the slab 1 due to the non-uniform demagnetizing field only under application of a uniform field. Hence, even if the size of the magnetic plate 7 is reduced slightly to weaken the field which is being superposed thereupon, this circulator is capable of offering characteristics identical to that available with the third embodiment. Thus the fourth embodiment, too, permits the size of the magnets and the magnetic circuit to be reduced, and the overall size of the device to be minimized.

Fifth through seventh embodiments of the invention are similar to the first through fourth embodiments, except that the grounding conductor 3 and part of one wide edge of the line conductor 1 are short-circuited. In the fifth through seventh embodiments, a local field is applied to an area near the shorted point unlike the prior art as shown, for example in FIG. 3.

Figure 12A:
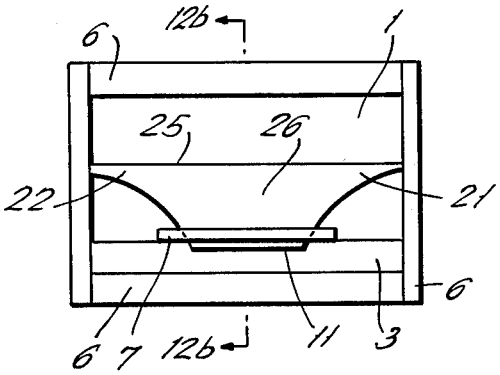
FIG. 12*a* is a plan view of an isolator of a fifth embodiment of the invention.
Figure 12B:
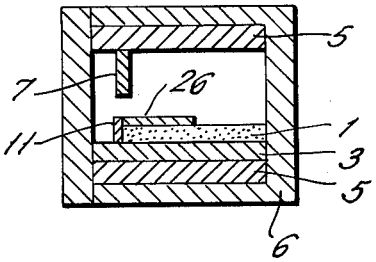
FIG. 12*b* is a cross-sectional view taken across 12*b*—12*b* of FIG. 12*a*.

FIGS. 12*a* and 12*b* schematically illustrate the construction of an isolator of fifth embodiment of the invention, in which one wide edge of the line conductor 26 at the edge of the ferrimagnetic slab 1 of the construction as in the second embodiment (FIG. 9), and the grounding conductor 3 are shorted by a shorting bar 11.

Figure 13:
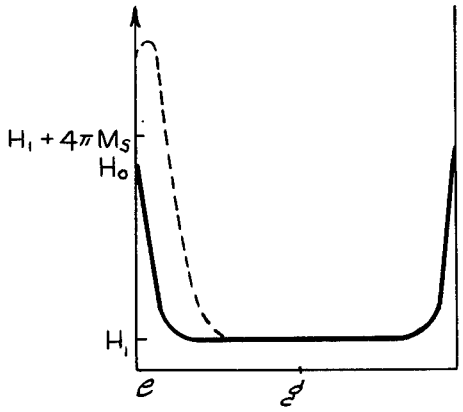
FIG. 13 is a graphic diagram showing the DC magnetic field intensity distribution in the isolator shown in FIG. 12.

FIG. 13 shows the distribution of the internal DC magnetic field in the isolator shown in FIGS. 12*a* and 12*b*; the solid line indicates the field distribution without the soft iron plate 7 installed, and the broken line indicates the field distribution with the soft iron plate 7 installed. The point *e* denotes the position of the shorting bar 11, and the point *g* the other edge 25 of the line conductor. In the isolator with the soft iron plate 7, the external field $H_o$ is nearly equal to the field along the edge, on which the field from the soft iron plate 7 is superposed. This isolator operates in the same manner as the one described in the first embodiment.

The fifth embodiment is advantageous over the prior art isolator in that magnetic resonance absorption can be extended to a high frequency region, or the frequency band can be widened, because a strong local field is applied to an area near the shorting bar 11.

In experiments on the fifth embodiment using the shorting bar 11 in the isolator of the construction as in the first embodiment, the frequency range was extended up to 8.0 GHz in the 4 to 8 GHz band, as opposed to 6 GHz in the 4 to 6 GHz band which is available with the isolator without the shorting bar provided. In other words, a bandwidth of 4 GHz can be obtained according to the fifth embodiment, against a bandwidth of 3.1 GHz which is obtained with the open type isolator of the first embodiment. This fact has been proved by numerically analyzing data on the short-circuit type isolator of the fifth embodiment and the open type isolator of the first embodiment.

Figure 14:
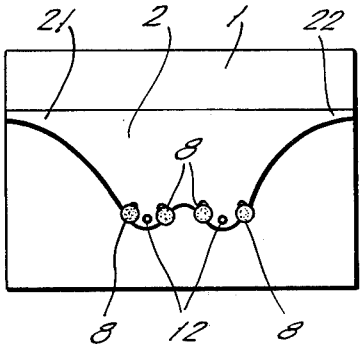
FIG. 14 is a schematic diagram showing an isolator of a sixth embodiment of the invention.

FIG. 14 schematically illustrates the construction of an isolator of a sixth embodiment of the invention which is fundamentally the same as the fifth embodiment. In FIG. 14, through-holes 12 are disposed in the line conductor 2 and thereby the line conductor and the grounding conductor 3 are short-circuited, and soft iron rods 8 are installed for providing a strong field locally in the vicinity of an edge of the line conductor. In this construction, the line conductor 2 is not necessarily installed at the edge of the ferrimagnetic slab 1. This facilitates fabricating the isolator into integration. Furthermore, by flaring the edge of the line conductor, the length of the line can be increased to enable the isolation to be increased, and the size of the device to be reduced.

FIGS. 15*a* and 15*b* schematically illustrate the construction of a circulator of a seventh embodiment of the invention. This embodiment corresponds to the fourth embodiment shown in FIG. 11, comprising a shorting bar 11 to provide a short circuit between the line conductor 2 and the grounding conductor 3. The feature of this technique is similar to that used for the isolator of the fifth embodiment.

The eighth and ninth embodiments of the invention are similar to the first and second embodiments respectively, except that the soft iron plate (or magnetic plate) 7 is not used in the eighth and ninth embodiments. The fact that the field at the edge of the line conductor is equal to the external field $H_o$ is utilized in connection with local fields. This isolator differs from the prior art one of FIG. 3 in that the shorting bar 11 is removed, i.e., this isolation is of the "open" type.

Figure 16A:
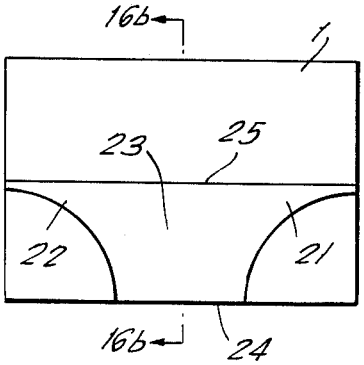
FIG. 16*a* is a plan view showing part of an isolator of an eighth embodiment of the invention.
Figure 16B:
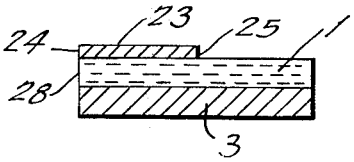
FIG. 16*b* is a cross-sectional view taken across 16*b* —16*b* of FIG. 16*a*.
Figure 17:
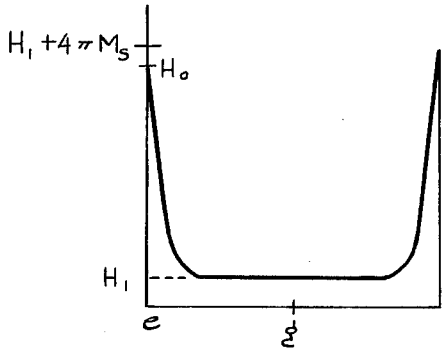
FIG. 17 is a graphic diagram showing the magnetic field intensity distribution in the isolator shown in FIG. 16.

FIGS. 16*a* and 16*b* schematically illustrate the construction of an isolator of eighth embodiment of the invention, in which an edge 24 of the line conductor 2 is made to meet the edge 28 of the ferrimagnetic slab 1. The field distribution in this structure is shown in FIG. 17. The field at the edge 24 of the line conductor 2 is equal to the field $H_o$ at the edge (the point *e* in FIG. 17) of the ferrimagnetic slab. The field in the center of the ferrimagnetic slab is smaller than the field $H_o$ by approximately the saturation magnetization $4\pi Ms$.

In this embodiment, the isolator construction can be markedly simplified although the frequency band cannot be much expanded because no strong local field is applied. Hence this isolator is useful for applications where a wide frequency band is not needed.

Figure 18A:
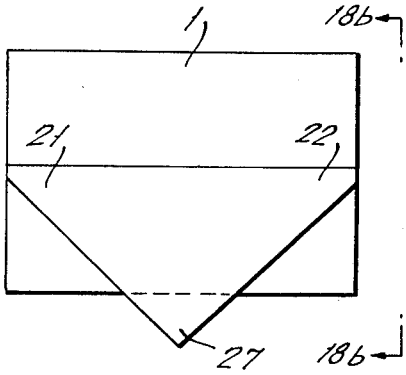
FIG. 18*a* is a plan view showing part of an isolator of a ninth embodiment of the invention.
Figure 18B:
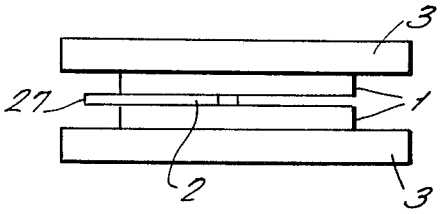
FIG. 18*b* is an end view looking in the direction of arrows 18*b*—18*b* of FIG. 18*a*.

FIGS. 18*a* and 18*b* schematically illustrates the construction of an isolator of the ninth embodiment of the invention, in which the line conductor 2 is extended outside the ferrimagnetic slab 1 and tapered straight, as opposed to the eight embodiment. By extending the line conductor 2 beyond the edge of the ferrimagnetic slab, the DC magnetic field fully intersects the high frequency field and hence the ratio of reverse-to-forward attenuation in the vicinity of the higher limit frequency of the isolator can be set to be large enough to enable the frequency band to be widened.

In the first through seventh embodiments, the isolation frequency characteristic can be arbitrarily controlled by suitably choosing the shape of the cross-section of the magnetic plate 7 such as a rectangle, triangle and semi-circle and thereby changing the distribution of the internal DC field. Similarly, the desired frequency characteristic can be obtained by changing the position of the magnetic plate 7 including the angle formed by the magnetic plate 7 with the wide edge 24 of the line conductor.

In the foregoing embodiments, the magnetic circuit of soft iron plate 7 is used to provide a locally strong field. For this purpose, a magnet or the combination of a magnet and the magnetic circuit may be used instead of the soft iron plate 7. The soft iron plate 7 may be replaced with a plurality of soft iron rods or screw bodies disposed along the edge of the line conductor. In the foregoing embodiments, the case 6 is used to close the magnetic circuit and serves as a magnetic shield. This shielding case may be U-shaped or of other open constructions. Instead of this case, a simplified magnetic circuit may be employed.

It is apparent that the invention is not limited to the disclosed microstrip structure but applicable to triplate structures.

In the foregoing circulator embodiments, a high isolation part is formed only at one edge portion in connection with the ports P3 and p4. The invention is not limited to the disclosed number of ports but is applicable to circulators having more ports. When more ports are employed, high isolation areas can be constituted simultaneously at a number of edge portions.

According to the invention, as has been described in detail, the magnetic resonance absorption of the ferrimagnetic body is utilized whereby a large isolation per unit length can be realized as opposed to a poor isolation available with a prior art isolator or circulator using a wave absorber. Accordingly, the size of the device can be reduced. Furthermore, because a local magnetic mechanism is employed, an internal DC field of desired intensity can be provided so that the entire frequency range for the edge-guided mode energy to be propagated in one direction without loss can be brought into full agreement with the frequency band used. According to the invention, therefore, isolators and circulators operable over a substantially wide frequency range can be realized without detracting from their efficiency and usefulness.

What is claimed is:

1. A non-reciprocal circuit element for microwave energy comprising:

a ferrimagnetic slab;

a strip-line conductor formed on one main surface of the ferrimagnetic slab and having first and second spaced edge portions of different lengths aligned parallel to the direction in which microwave energy is chiefly propagated; said conductor having a generally trapezoidal shape in which the ends of said conductor taper from said first edge portion to said second edge portion; the ends of said second edge portion defining the end portions of said conductor;

a grounding conductor held in contact with the other main surface of the ferrimagnetic slab and kept at a ground potential;

a first means for applying a DC magnetic field to the ferrimagnetic slab in a direction perpendicular to the plane of said ferrimagnetic slab, wherein a non-reciprocal propagation characteristic is exhibited at opposing edge portions of the strip-line conductor, characterized in that a second means is provided for developing a non-uniform DC magnetic field distribution at least along one edge portion of the strip-line conductor in cooperation with said first means for applying a DC magnetic field to the ferrimagnetic slab;

said second means being comprised of means for supplying a magnetic field to one of said edges of said stripline conductor, the strength of the magnetic field being sufficient to cause said ferrimagnetic slab to bring about a magnetic resonance.

2. A non-reciprocal circuit element for microwave energy as claimed in claim 1 wherein said first edge portion and said second edge portion are located respectively in the vicinity of the center line of the ferrimagnetic slab and in coincidence with the edge of the ferrimagnetic slab, thus constituting said means for making the magnetic field distribution non-uniform.

3. A non-reciprocal circuit element for microwave energy as claimed in claim 1 wherein said magnetic field supplying means is comprised of a body disposed along one edge of said conductor and is formed of a magnetic material taken from the group of materials consisting of soft iron, magnetic shunt alloy, barium ferrite and alnico.

4. A non-reciprocal circuit element for microwave energy as claimed in claim 1 wherein a portion of one edge of said strip-line conductor is electrically connected to said grounding conductor.

5. A non-reciprocal circuit element for microwave energy as claimed in claim 1 wherein at least one additional microwave input and output means is electrically connected along the end portions of said strip-line conductor and between said edge portions for operating said non-reciprocal circuit element as a circulator.

6. The non-reciprocal circuit element of claim 5 having still another microwave coupling means connected along the border edge portion of said conductor.

7. The non-reciprocal circuit element of claim 1 wherein said tapered sides are curved.

8. The non-reciprocal circuit element of claim 1 wherein said tapered sides are straight.

9. The non-reciprocal circuit element of claim 1 wherein said end portions flare outwardly from said first edge portions towards said second end portion to form a central portion of enlarged width relative to said first edge portion and wherein said end portions taper inwardly between said central portion and said second edge portion.

10. The non-reciprocal circuit element of claim 9 wherein microwave energy coupling means are connected to said conductor at appointed sides of said central portion and along said end portions.

11. A non-reciprocal circuit element for microwave energy as claimed in claim 1 wherein said first edge portion and said second edge portion are located respectively in the vicinity of the center line of the ferrimagnetic slab and beyond the adjacent edge of the ferrimagnetic slab, thus constituting said means for making the magnetic field distribution non-uniform.

* * * * *